US005305692A

United States Patent [19]

Madison et al.

[11] Patent Number: 5,305,692

[45] Date of Patent: Apr. 26, 1994

[54] TRUCK MOUNTED TIE EXCHANGER WITH SELF-ALIGNING TIE CLAMP

[75] Inventors: Harry Madison, Germantown, Tenn.; Robert F. Ryan, Fairmont; Michael B. Gilbert, both of Fairmont, Minn.

[73] Assignee: Harsco Corporation, Wormleysburg, Pa.

[21] Appl. No.: 913,161

[22] Filed: Jul. 14, 1992

[51] Int. Cl.[5] ..... E01B 29/10

[52] U.S. Cl. ..... 104/9; 104/7.1; 294/106; 294/902

[58] Field of Search ..... 104/7.1, 9; 269/258, 269/259, 260, 261, 262, 263, 264; 294/902, 106

[56] References Cited

U.S. PATENT DOCUMENTS

| | | | |
|---|---|---|---|
| 2,756,520 | 7/1956 | Soule | 37/104 |
| 3,047,968 | 8/1962 | Keller et al. | 104/5 X |
| 3,139,302 | 6/1964 | Orloff et al. | 294/902 X |
| 3,780,664 | 12/1973 | Holley et al. | 104/9 |
| 3,964,397 | 6/1976 | Dieringer et al. | 104/9 |
| 4,282,663 | 8/1981 | Theurer | 104/6 X |
| 4,360,980 | 11/1982 | Jarvis | 37/117.5 |
| 4,392,433 | 7/1983 | Nyland | 104/9 |
| 4,421,034 | 12/1983 | Allmer | 104/9 |
| 4,595,333 | 6/1986 | Ono et al. | 294/902 X |
| 4,809,614 | 3/1989 | Theurer et al. | 104/9 X |
| 4,951,573 | 8/1990 | Madison | 104/9 |
| 4,955,302 | 9/1990 | Theurer | 104/9 X |
| 5,119,723 | 6/1992 | Lovitt, Jr. | 104/9 X |

FOREIGN PATENT DOCUMENTS

| | | | |
|---|---|---|---|
| 466400 | 1/1975 | United Kingdom | 104/9 |

OTHER PUBLICATIONS

W-119 Boom and Cab Design by applicant, general sketch and operation of W-119.

*Primary Examiner*—Robert J. Oberleitner
*Assistant Examiner*—S. Joseph Morano
*Attorney, Agent, or Firm*—Kerkam, Stowell, Kondracki & Clarke

[57] ABSTRACT

A tie exchanger assembly is mounted upon a truck and is used for removal and insertion of ties in a railroad roadbed. A boom is mounted to a rail clamp table which is vertically movable between an upper stored position and a lowered operable position. The boom is mounted to the center of the rail clamp support table and is rotatable 180° about a vertical axis so that the boom may be used for manipulating ties on both sides of the vehicle. Rail clamps and rail engagement wheels are mounted to the underside of the rail clamp table. The boom is pivotable about a horizontal pivot axis. A tie clamp is mounted at a distal end of the boom. A self-aligning tie clamp may advantageously be used so as to clamp concrete ties or other ties with irregular or concave surfaces.

37 Claims, 8 Drawing Sheets

TRUCK MOUNTED TIE EXCHANGER WITH SELF-ALIGNING TIE CLAMP

BACKGROUND OF THE INVENTION

This invention relates to a tie exchanger with a self-aligning tie clamp for replacing ties in a railroad track bed. More specifically, this invention relates to such a tie exchanger mountable on the back of a vehicle such as a truck or other road vehicle. (As used herein, a road vehicle is a vehicle which is designed for normal operation along roads, as opposed to vehicles limited to movement along rails and vehicles such as tractors, bulldozers, or backhoes designed for normal operation off of roads.)

In order to maintain railroad tracks in safe operating conditions, it is necessary to replace the ties periodically. The ties (made of wood, metal, or concrete) underneath the rails tend to wear out after an extended period of use.

Among the various machines which have been used for removing and inserting railroad ties is the machine described in U.S. Pat. No. 4,951,573 issued Aug. 28, 1990 to Harry Madison, one of the present inventors, and assigned to the assignee of the present application. That patent, hereby incorporated by reference, describes a tie remover/inserter machine which uses the vehicle of a conventional backhoe with various modifications.

Various other rail-bound vehicles having tie remover and inserter mechanisms mounted thereon have been used. Such vehicles are quite appropriate for use when replacing the ties over a relatively large section of rail roadbed. However, it may be expensive or difficult to bring in such a vehicle if a relatively small number of ties need replacement. For such situations, a railroad often has used a truck equipped with rail guide wheels and various hand tools to remove and insert ties. The rail guide wheels may be lowered so that a road vehicle, such as a truck, may travel along the rails until it reaches the location in need of repairs. Such a truck has often been equipped with a crane and winch to assist with handling the ties. Disadvantageously, exchanging ties in this manner is very labor intensive and slow.

Tie inserters have traditionally had clamps which may be used to grip the ties so that old ties may be removed from the roadbed and new ties may be inserted into the roadbed. Unfortunately, such tie clamps have had a great tendency to damage concrete ties because of the concave surfaces on such ties. In particular, tie clamps have had difficulty securely gripping ties, such as concrete ties, with concave surfaces or with irregular surfaces without damaging the ties.

OBJECTS AND SUMMARY OF THE INVENTION

Accordingly, it is a primary object of the present invention to provide a new and improved tie exchanger.

A more specific object of the present invention is to provide a tie exchanger (i.e., device used for both removing and inserting ties) which is mounted upon a truck for efficiently exchanging ties.

A still further object of the present invention is to provide a tie exchanger which is relatively simple in design, but which allows ties to be removed from a roadbed or inserted into a roadbed from either side of the vehicle on which the tie exchanger is mounted.

A still further object of the present invention is to provide a highly stable and reliable arrangement to allow movement of a tie exchanger from a raised or road position to a lower or work position.

A still further object of the present invention is to provide a tie clamp which will readily accommodate concave surfaces or irregularities in a tie without damaging the tie.

The above and other objects of the present invention which will become apparent upon reading the following detailed description are realized by a tie exchanger assembly having an attachment frame for stationary mounting to the frame of a vehicle. The assembly is a road vehicle tie exchanger assembly for mounting on a road vehicle. (In other words, the attachment frame is stationary relative to the frame of the road vehicle.) A support is movably mounted to the attachment frame. At least one lift actuator is operably connected to lift the support relative to the attachment frame. A tie exchanger includes a tie clamp and is secured at a vertical pivot point to the support. The vertical pivot point corresponds to a vertical axis about which the tie exchanger is pivotable relative to the support. The tie exchanger is operable to remove old ties from a rail roadbed and to insert new ties in a rail roadbed. The tie exchanger is rotatable at least 180° about the vertical pivot point for removal of ties from both right and left sides of the vehicle. The support has rail clamps mounted to opposite ends of it. The support is mounted to the attachment frame by parallel link pairs, there being one link pair at each of the opposite ends of the support. The link pairs maintain the orientation of the support. Rail engagement wheels are mounted to opposite ends of the support and within (i.e., at least part of the wheels are within) 30 centimeters of a vertical plane extending perpendicular to a rail direction (i.e., the direction in which the rails extend) and in which the vertical pivot axis is disposed. The tie exchanger is preferably a telescoping boom with the tie clamp mounted at a distal end thereof. The telescoping boom is mounted to the support by way of a pivot frame and the telescoping boom is pivotable about a horizontal axis relative to the pivot frame. A torsion member extends between opposite ones of the links. The tie exchanger assembly is mounted to a truck also having a crane and outriggers. The tie clamp has opposite jaws, each jaw having at least two contact surfaces which have at least one degree of freedom for self-aligning movement upon clamping a tie. In other words, each contact surface can move in at least one direction relative to the remainder of the jaw. The support is movable sideways relative to the attachment frame such that sideways forces (i.e., perpendicular to the rail direction) from insertion and removal of ties are absorbed with no or minimal application of the forces to the attachment frame. The link pairs have spherical ball joint bearings at their ends to allow sideways movement of the support relative to the attachment frame. The rail clamps are mounted to opposite ends of the support and are disposed in a vertical plane in which ties are moved for insertion and removal. (In the specific case of using a telescoping boom, the vertical plane is a plane in which the telescoping boom is extendable.)

The present invention may alternately be described as a tie exchanger assembly having a tie exchanger operable for removing and inserting ties in a rail roadbed, the tie exchanger having a tie clamp mounted on an end thereof. The tie clamp has opposite jaws, each jaw having at least two contact surfaces which have at least one degree of freedom for self-aligning movement upon clamping a tie. More specifically, each contact surface has two degrees of freedom. Each of the jaws includes at least three separate contact surfaces. The tie clamp may further include a tie clamp actuator and opposite tie clamp arms, each tie clamp arm secured to opposite ends of the tie clamp actuator. Each tie clamp arm has one of the jaws movably mounted to it to allow pivoting about a jaw axis. Each jaw has a jaw frame pivotable about the jaw axis of that jaw, each jaw frame having the contact surfaces movably mounted thereto. Each contact surface is pivotable about an associated contact axis relative to the jaw frame. At least two of the contact surfaces of each jaw are movable independent of each other. Each jaw includes a curved member having opposite ends with one of the contact surfaces at each end, each curved member pivotably captured within part of the jaw frame. The tie exchanger assembly further includes an attachment frame for stationary mounting to the frame of a road vehicle and a support movably mounted to the attachment frame, the tie exchanger mounted to the support.

The present invention may alternately be described as a tie clamp jaw having a jaw frame and at least two contact surfaces movably mounted to the jaw frame, the contact surfaces having at least one degree of freedom for self-aligning movement upon clamping a tie. More specifically, the contact surfaces would have at least two degrees of freedom. There are at least three contact surfaces. The jaw frame is pivotably mounted to a retention plate. The tie clamp jaw is mounted to a tie clamp, which tie clamp is part of a tie exchanger assembly as described above.

BRIEF DESCRIPTION OF THE DRAWINGS

The above and other features of the present invention will be more readily understood when the following detailed description is considered in conjunction with the accompanying drawings wherein like characters represent like parts throughout the several views and in which.

DETAILED DESCRIPTION

Figure 1:
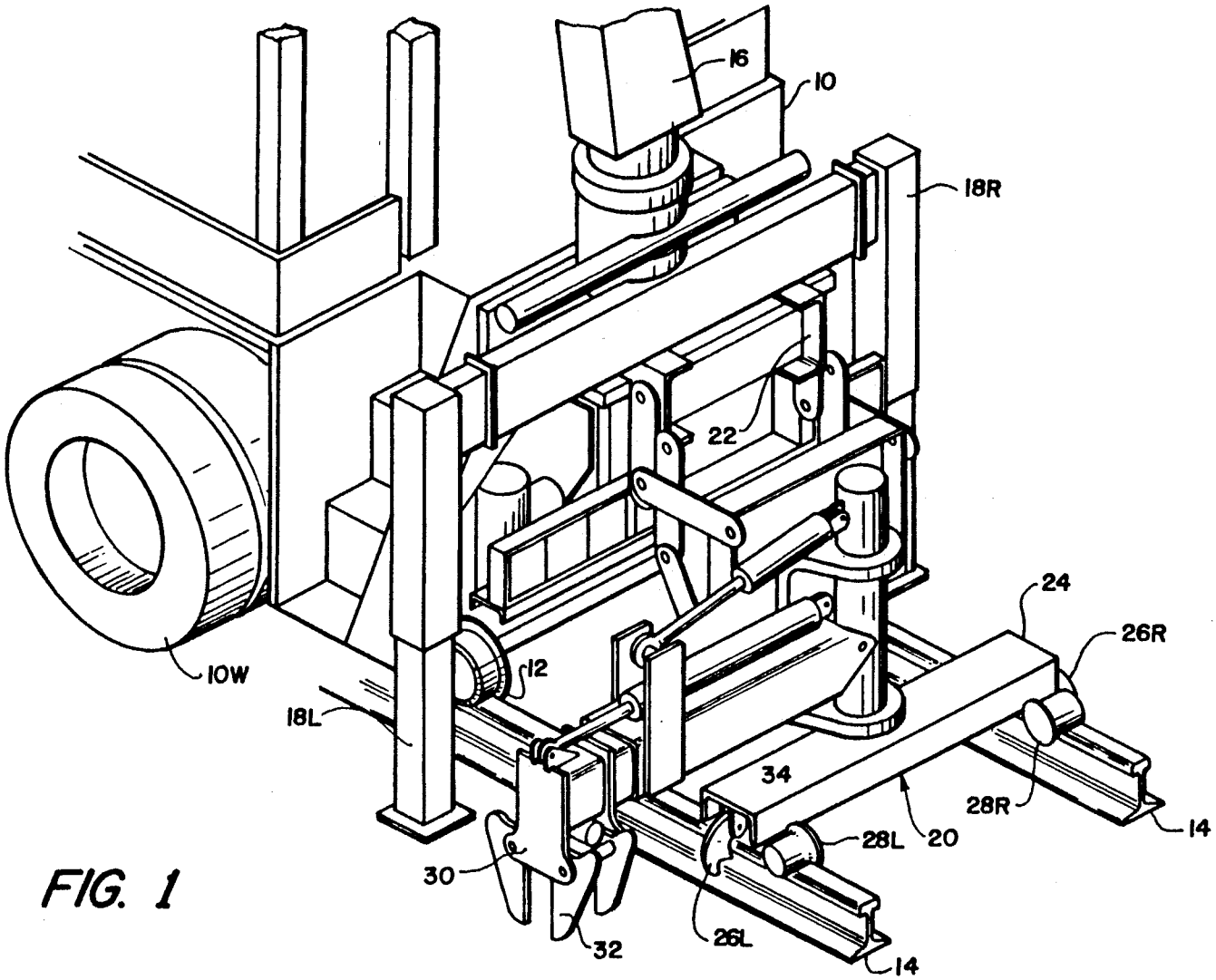
FIG. 1 is a perspective simplified view of the present invention.

As shown in FIG. 1, a truck 10 (only a portion of the back of the truck is shown) has road wheels 10W for traveling along a road or highway. However, the vehicle is truck 10 further includes rail engagement guide wheels 12 (only one shown) for engaging rails 14. The rail guide wheels 12 are mounted to the vehicle 10 in known fashion to allow vehicle 10 to travel along rails 14 by lowering of at least four guide wheels, one guide wheel corresponding generally to each corner of the truck or vehicle 10. More than four of the guide wheels 12 may be used and the guide wheels 12 may be mounted to bogies which may be raised and lowered to engage and disengage the rails 14 in known fashion. Alternately, if desired, the front and back guide wheels may be constructed like the structures disclosed respectively in Harry Madison's U.S. patent applications, Ser. Nos. 07/755,115 and 07/777,142, filed respectively Sept. 5, 1991 and Oct. 16, 1991, entitled respectively RAIL ENGAGEMENT APPARATUS WHICH USES VEHICLE SUSPENSION and SIDE SHIFT RAILWAY GUIDE WHEEL APPARATUS, assigned to the assignee of the present application and hereby incorporated by reference.

Mounted to the back of truck 10 in known fashion is a crane 16 (only partially shown), which may be part of a commonly available assembly also including right and left outrigger jacks 18R and 18L. The crane 16 may be used to manipulate ties, whereas the outriggers 18R and 18L will be used to lift the rails 14 as discussed below.

Mounted also to the back of the truck 10 is a tie exchanger assembly 20 according to the present invention. The details of the tie exchanger assembly 20 will be discussed below, but the simplified perspective of FIG. 1 allows a brief explanation of the major components of the assembly 20. An attachment frame 22 allows attachment to the truck 10 and has a support 24 movably mounted to it. The support 24 functions as a rail clamp table having rail clamps 26R and 26L mounted at opposite ends thereof. Additionally, wheels 28R and 28L are mounted to the support 24 for engaging rails 14. Mounted to the support 20 is a tie exchanger 30 which includes a tie clamp 32 mounted at an end of a boom 34. The tie clamp 32 is used to engage ties for insertion or removal from the roadbed.

Figure 2:
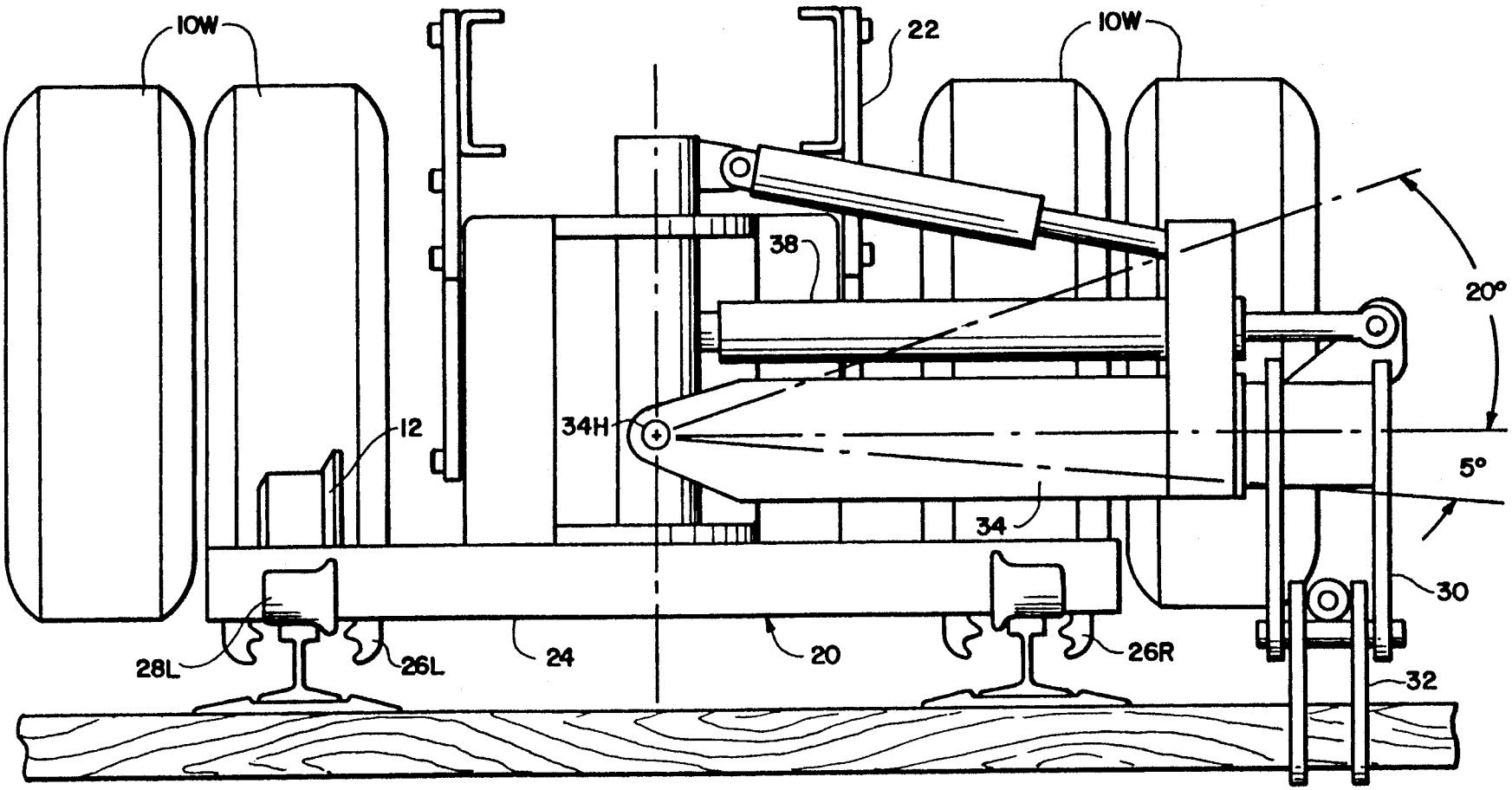
FIG. 2 is a simplified back view of the present invention.

Turning now to the simplified back view of FIG. 2, it will be appreciated that the boom 34 has a range of movement of 20° above horizontal and 5° below horizontal by pivoting about horizontal pivot axis 34H. The boom 34 may be extended and retracted in telescoping fashion by use of an extension actuator or cylinder 38.

Figure 3:
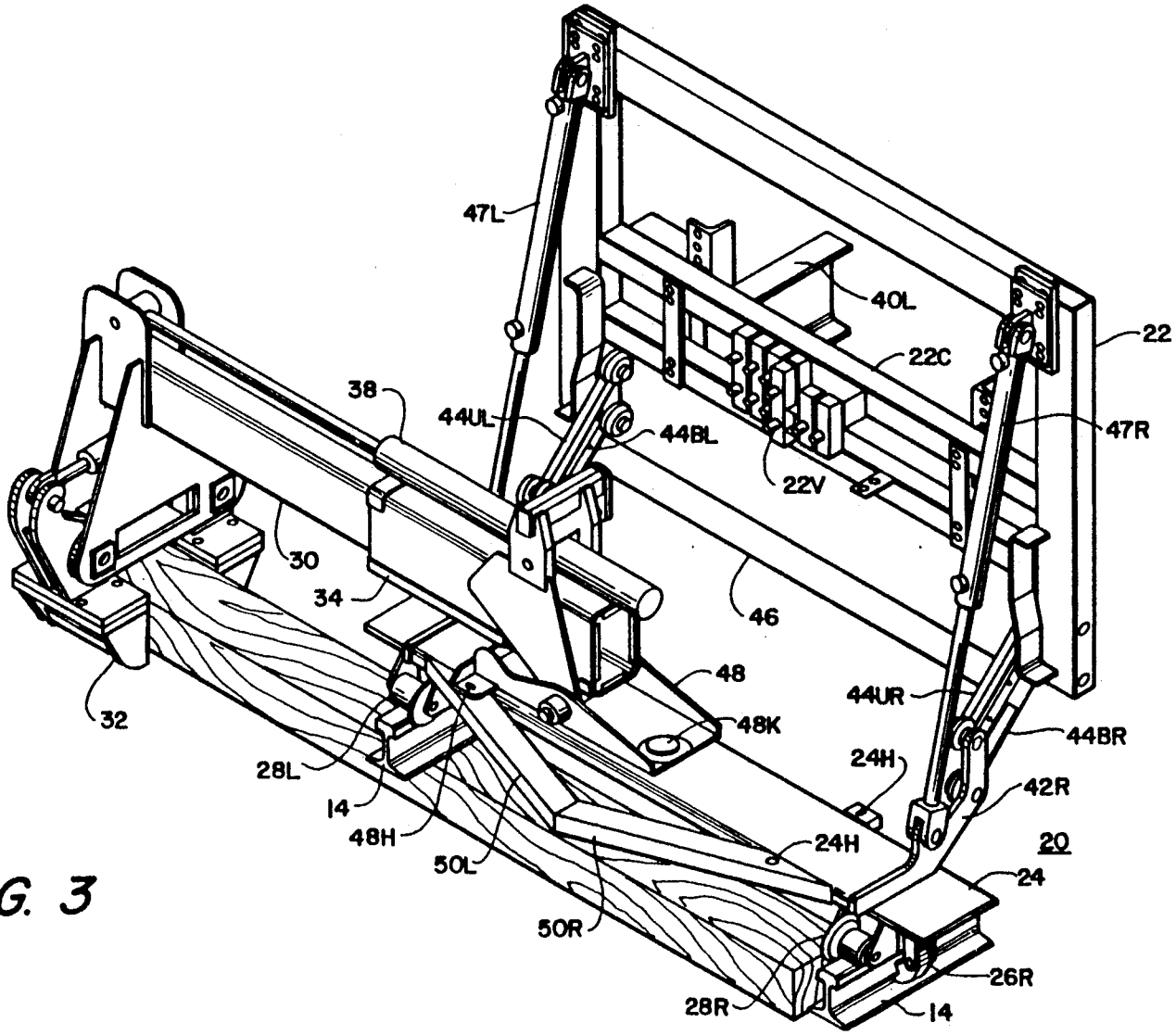
FIG. 3 is a perspective view of a tie exchanger assembly according to the present invention.

Turning now to FIG. 3, the structure of the tie exchanger assembly 20 will be discussed in more detail. The frame 22 has a cross member 22C which is welded, bolted, and otherwise attached to a truck frame member or extension 40L and a similar right side truck frame member or extension (not shown). Since the structure of assembly 20 is largely symmetric, numerous components which will be discussed will have corresponding right and left components which will be marked R and L respectively. For ease of discussion, it will be understood that the right and left components operate identically unless specifically noted otherwise.

Mounted to the cross member 22C are a series of hydraulic valves 22V which may operate in known fashion to control the various hydraulic cylinders which are used for moving the components of the assembly 20. For ease of illustration, the various hydraulic lines are not shown in the drawings.

The support or rail clamp table 24 is mounted to the attachment frame 22 by way of a vertically extending member 42R, fixed to the upper surface of table 24, and by upper and lower links 44UR and 44BR respectively. Similar links 44 UL and 44BL are mounted at the opposite side of the table 24 to a member (not visible) identical to the right side member 42R. A torsion tube 46 extends between links 44BR and 44BL to maintain those two links essentially parallel. Each of the right and left pairs of the links serve as part of a four bar linkage such that the table 24 will maintain its orientation. That is, the upper surface of the table 24 will define a plane which is perpendicular to the generally vertical plane corresponding to the attachment frame 22. The ends of the various links are fitted with spherical ball joint bearings to allow horizontal motion of the table 24 and parts mounted thereon. In other words, the table 24 may track the rails 14 by way of wheels 28R and 28L without being overly constrained by the sideways movements of attachment frame 22 as it follows movements of the vehicle to which it is attached. This feature allows proper operation at curved parts of the rails. Although not shown in FIG. 3, each end of the table 24 would have two of the rail engagement wheels such as 28L and 28R.

The table 24 is movable up and down relative to the attachment frame 22 by right and left lift cylinders 47R and 47L respectively. Specifically, these cylinders extend between the attachment frame 22 and the support or table 24. As shown at the right side of FIG. 3, the cylinders, such as 47R may connect to the support or table 24 by way of the vertical member 42R. The cylinders 47R and 47L act as tension links so to transfer the rail lift forces provided by outriggers 18R and 18L (FIG. 1) to the rail clamps 26R and 26L.

Figure 5:
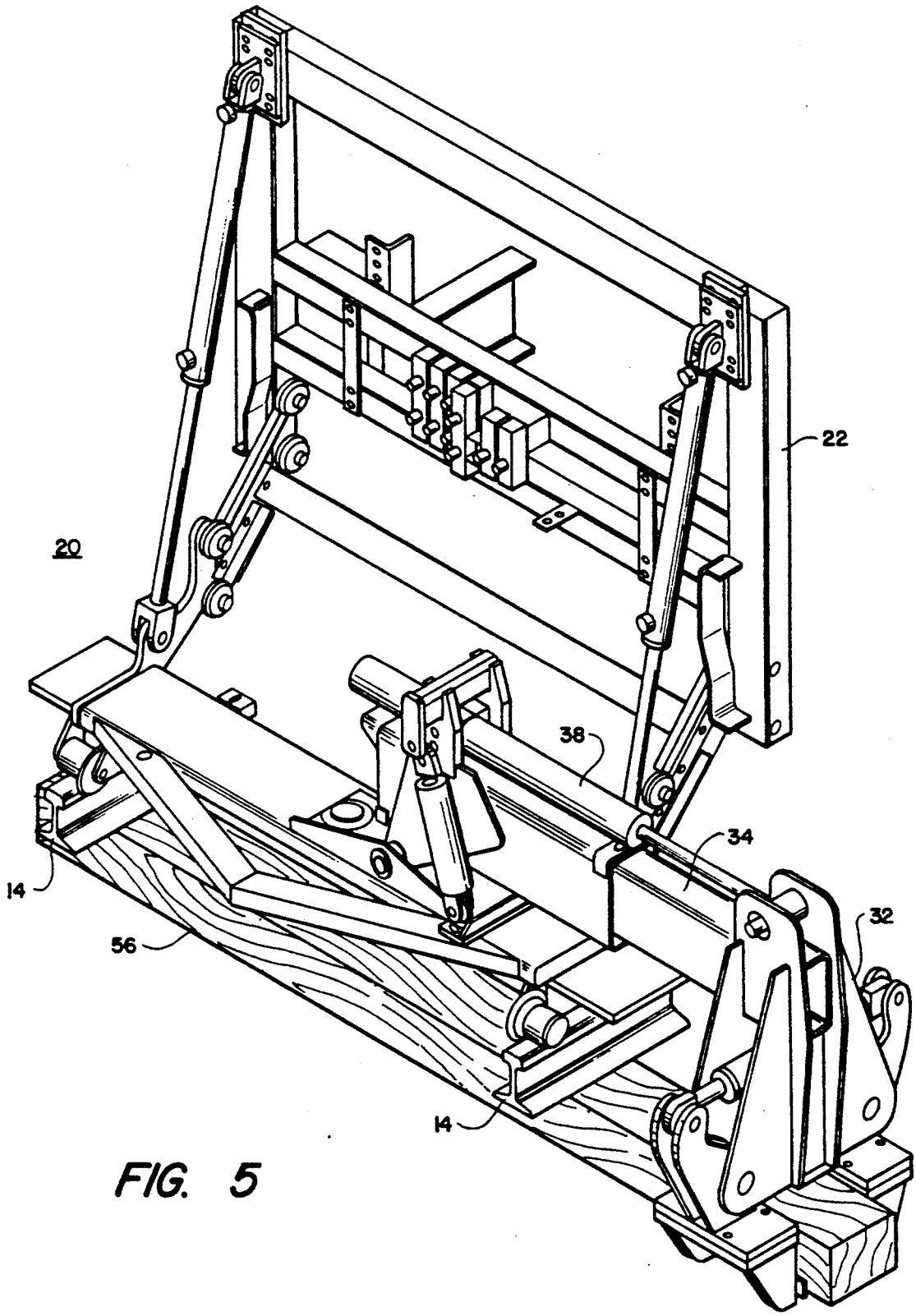
FIG. 5 is a perspective view of the tie exchanger assembly with a boom in a halfway retracted position.
Figure 6:
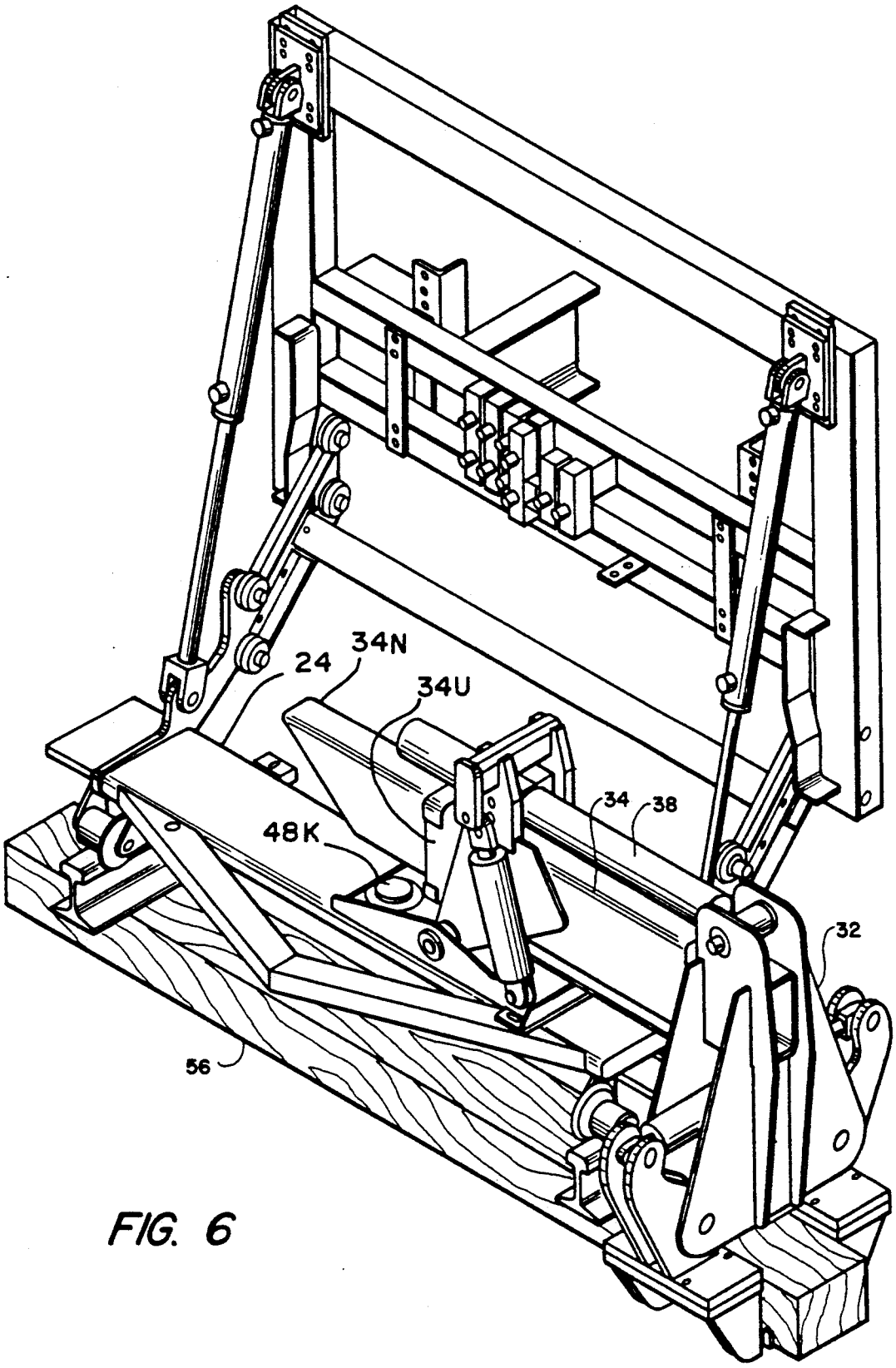
FIG. 6 is a perspective view similar to FIG. 5 except that the boom is fully retracted.

The boom 34 is mounted to a pivot frame 48 which is secured by kingpin 48K to the center of the table or support 24, which extends in a rail to rail direction as shown. By removing two bolts (not separately shown) extending through hole 48H and a similar hole (which is not visible in FIG. 3), the pivot frame 48 may be rotated from its left side position in FIG. 3 to a right side position where upon the bolts may be replaced in the holes, such as 48H, in the pivot frame 48 and extend through holes 24H mounted to members attached to the table 24. The pivot frame 48 and exchanger 30 mounted thereon may simply be manually turned from its left side position in FIG. 3 to a right side position which is illustrated by FIGS. 5 and 6 discussed in more detail below. Mounted to the support 24 are side members 50L and 50R which help support the pivot frame 48 and associated structure as it is manually moved between its positions. Further, wear pads (not shown) or other arrangements may be used to make it easier to pivot the pivot frame 48 about the vertical pivot axis corresponding to kingpin 48K without undue friction.

Figure 4:
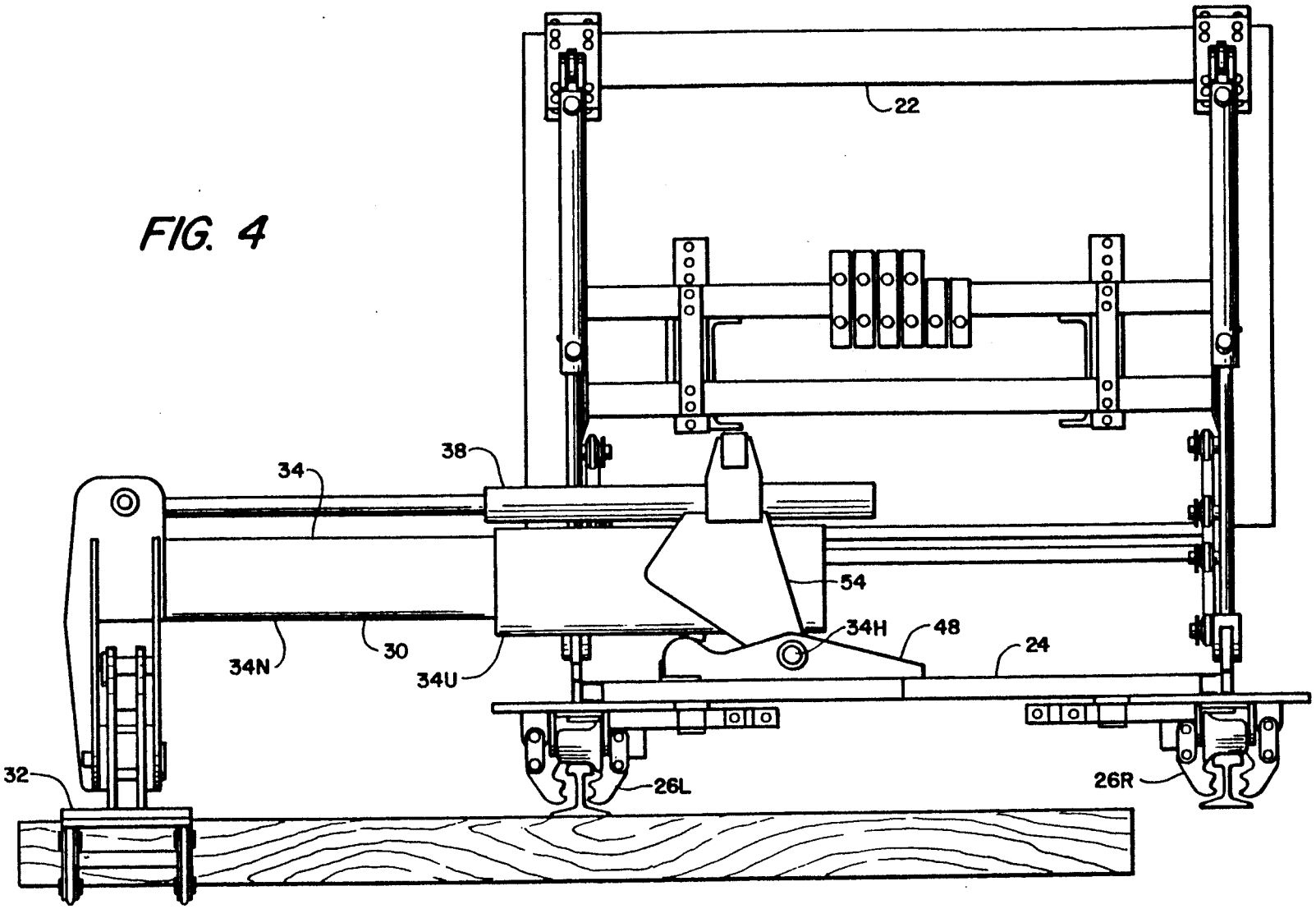
FIG. 4 is a back view of the tie exchanger assembly of FIG. 3.

Continuing to view FIG. 3 but also considering the view of FIG. 4, the tie exchanger 30 including boom 34 is rotatable about a horizontal axis 34H over the range of movement previously discussed. Specifically, an actuator or cylinder 52 (FIG. 4 only, not shown in FIG. 3 for ease of illustration) rotates mount flange 54 which in turn rotates boom 34. Although FIG. 4 shows only one horizontal pivot cylinder 52 and mount flange 54, identical components could also be located immediately behind the boom 34 in the view of FIG. 4. The outer section 34U of boom 34 would have the plates or mount flanges 52 fixed to it. The hydraulic cylinder 38 extends inner boom section 34N and retracts it to within outer section 34U in telescoping fashion. The interior walls of the outer boom (not separately shown) may be equipped with low friction bearing pads to allow easy telescoping action of the inner boom 34N.

Although not visible in FIGS. 3 and 4, hydraulic cylinders would be used to activate rail clamps 26R and 26L in known fashion. Rail clamps 26R and 26L are preferably directly in line with boom 34 and would at least be within 30 centimeters of a vertical plane perpendicular to the rail direction which extends through king pin 48K (which is discussed below).

Turning now to FIGS. 5 and 6, the tie exchanger 30 has been moved to its right side position and the boom 34 has been partially retracted by operation of cylinder 38 so as to partially insert a new tie 56 beneath the rails 14. In FIG. 6, the cylinder 38 has been completely retracted and in turn has retracted the boom 34 such that the new tie 56 is now completely under the rails 14. As clearly shown in FIG. 6, the inner boom section 34N extends over the vertical pivot point corresponding to 48K when the boom is retracted.

An important feature of the present invention is that sideways forces from insertion and removal of ties are absorbed with no or minimal application of the forces to the attachment frame. In particular, and with reference to FIGS. 3 and 4, the rail clamps 26R and 26L (FIG. 4 only) are disposed in a vertical plane in which ties are moved for insertion and removal. Therefore, any sideways forces (i.e., perpendicular to the rail direction) are applied from the table 24 to the rails 14 by way of the rail clamps 26R and 26L. Thus, support or table 24 will resist sideways movement which might otherwise be caused by the moving of a tie into or out of the roadbed. To the extent that support or table 24 is moved slightly sideways as the rails 14 move slightly sideways when inserting or removing a tie, the spherical ball joint bearings at the ends of links 44BR, 44UR, 44UL, and 44BL will prevent or at least minimize any transmission of sideways forces which might otherwise tend to move attachment frame 22 and, in turn, tend to move the vehicle to which it is attached. Preventing or minimizing the transmission of sideways forces to the vehicle will minimize the risk that the vehicle would derail when inserting or removing a tie.

Figure 7:
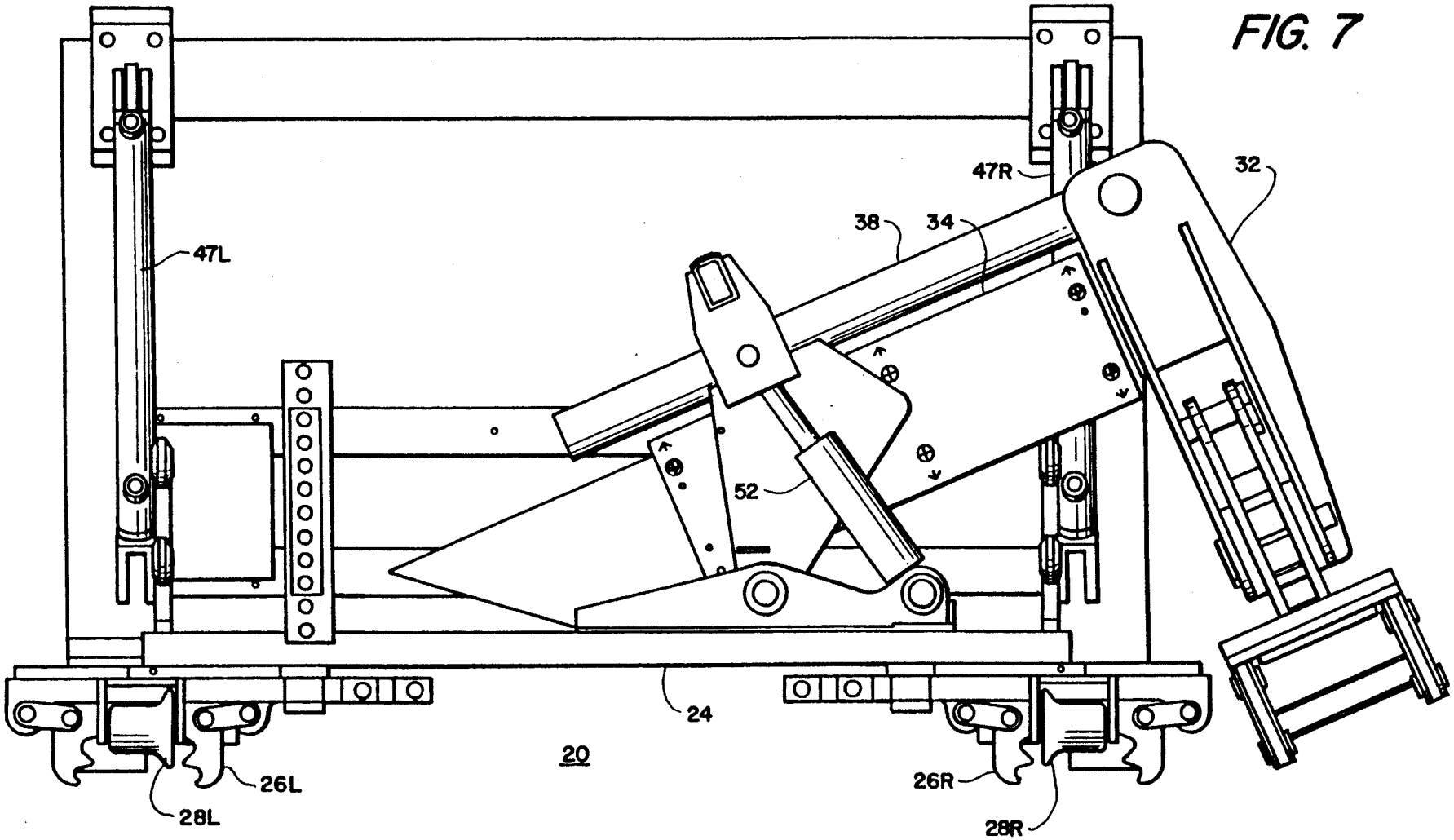
FIG. 7 is a back view of the tie exchanger assembly with various parts in a stored or road position.

With reference now to FIG. 7, the tie exchanger 30 has been placed in a storage position with the boom 34 completely retracted and raised to the uppermost end of its tilt range by operation of tilt or horizontal pivot cylinder 52. At the same time, the lift cylinders 47R and 47L have been completely retracted so that the support 24 is at an uppermost storage or road position with the wheels 28R and 28L, rail clamps 26R and 26L, and other structures lifted substantially above any road surface so that the truck may travel along a highway without any portion of the assembly 20 contacting the highway or other roadbed. Locking pins (not shown) or other known locking arrangements may be used to secure the assembly 20 in its upper or road position illustrated in FIG. 7.

Figure 8:
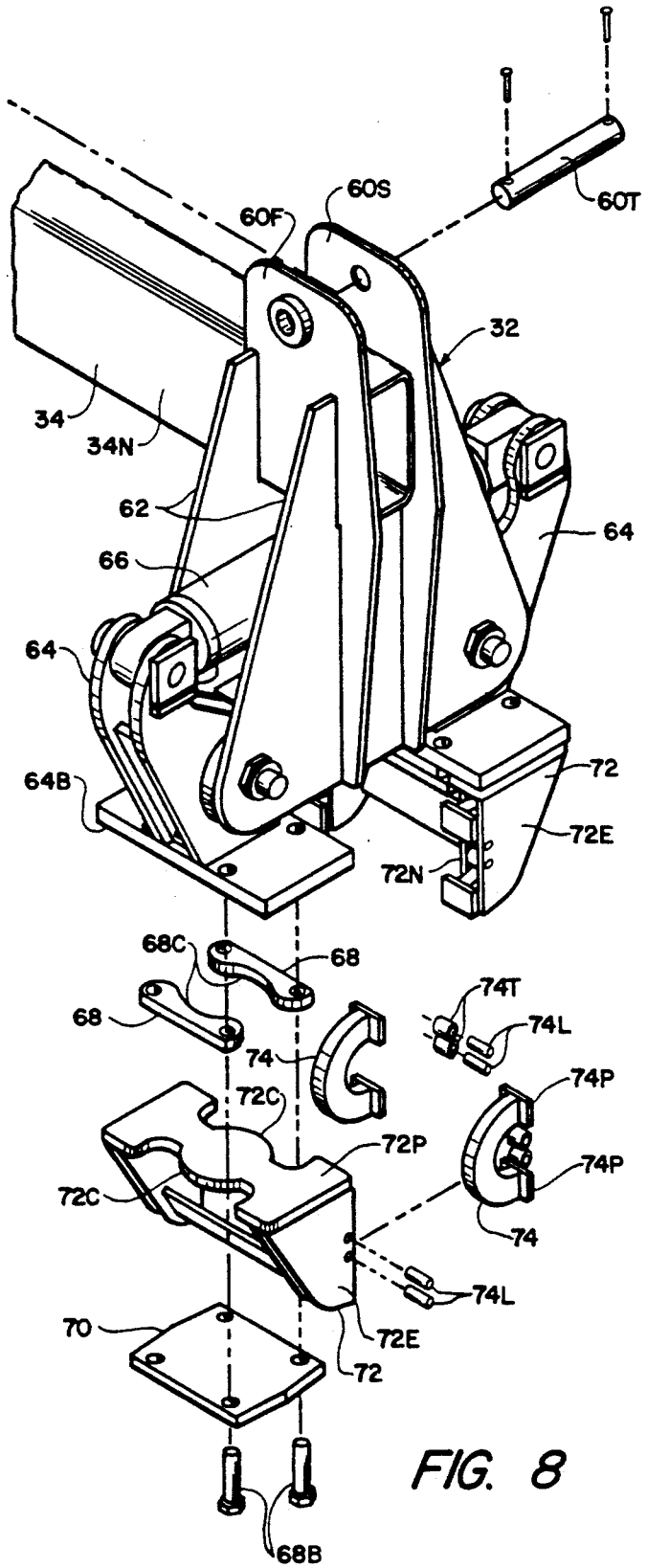
FIG. 8 is a perspective exploded view of a tie clamp according to the present invention.

With reference now to FIG. 8, a specific arrangement for the tie clamp 32 will be discussed. The present invention may use a conventional tie clamp of any previously known structure. However, the present invention preferably would include a self-aligning tie clamp as will be discussed. The tie clamp 32 includes first and second parallel plates 60F and 60S which are fixed to the inner section 34N of boom 34. A tube 60T extends between the plates 60F and 60S to allow the pivotable mounting of the rod end of cylinder 38 (not shown in FIG. 8) thereto. Mounted to each of the plates 60F and 60S are pairs of mount flanges 62 having tie clamp arms 64 pivotably mounted thereto. The tie clamp arms 64 have a tie clamp cylinder 66 pivotably extending between them. Activating the cylinder 66 may be used to clamp and unclamp the tie clamp 32. Each of the structures 64 is identical and has identical parts mounted to it, whereas FIG. 8 and the discussion which follows will concentrate on the components attached to the tie clamp arm 64 at the left of FIG. 8.

Figure 9:
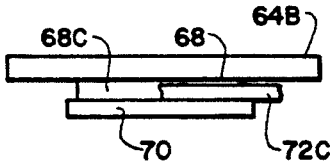
FIG. 9 is a side view of parts of the structure of FIG. 8.

The tie clamp arm 64 has a bottom plate 64B with two spacers 68 mounted on its underside by way of bolts such as bolts 68B (for ease of illustration only two bolts are shown, but four would be used). Each of the bolts 68B would pass through a corresponding one of four holes in a retention plate 70. A jaw frame 72 would be movably captured within the space between opposing contoured edges 68C of the spacers 68. Continuing to view FIG. 8, but momentarily referring to the view of FIG. 9 wherein one of the spacers 68 has been deleted, the capturing of jaw frame 72 between the plates 64B and 70 and between the spacers 68 will be more readily understood. Specifically, the jaw frame 72 includes a generally horizontal plate 72P having curved portions 72C forming an hourglass shape which mate with the curved portions 68C of spacers 68. As illustrated in FIG. 9, the curved portions 72C captured between the spacers 68 will have a thickness less than the thickness of the spacers 68 so that curved portion 72C of plate 72P may move about a vertical axis (i.e., perpendicular to plates 64B and 70). If desired, bearing pads (not shown) or other bearing arrangements could be used to facilitate rotation of plate 72P within the spacers 68. The retention plate 70 may be considered as a mount to which jaw frame 72 is movably mounted. The retention plate 70 is fixed to the bottom plate 64B, which may be considered as an anchor plate. As will be appreciated, the shape of that portion of jaw frame 72 captured between retention plates 70 and anchor plate 64B defines the rotation of the jaw frame. More specifically, the curves 72C define the rotation of the jaw frame.

Curved members 74 are captured for movement relative to each of the jaw frames 72. Specifically, each of the curved members 74 has two contact surfaces or pads 74P at opposite ends thereof. An intermediate portion of each of the curve members 74 extends between the two contact surfaces 74P and is pivotably captured within part of the jaw frame 72. The jaw frame 72 has an end plate 72E at each end thereof. Briefly referring to the right jaw frame 72 of FIG. 8, an inner plate 72N is disposed just inside of plate 72E and parallel thereto with sufficient room to accommodate the curved member 74 for rotation with respect to the jaw 72. In particular, the curve member 74 is captured between two plates such as 72E and 72N by use of two roll pins 74L extending between the two plates and extending through tubes 74T. The pins 74L tend to spring outwardly or unroll and bind to holes in the adjacent plates such as 72E and 72N. The tubes 74T are captured between the plates 72E and 72N with the pins 74L extending there through. Advantageously, there is one curved member 74 and associated structure at least at each end of the jaw frame 72. Each curved member 74 is pivotable about a contact surface axis which is perpendicular to the axis corresponding to jaw frame 72 moving relative to plate 64B. Accordingly, each of the four contact surfaces 74P for each jaw has two degrees of freedom. Moreover, each curved member 74 may pivot about its contact surface axis independent of pivoting of the other curved member 74 about its contact surface axis. Each degree of freedom provides self-aligning movement. One degree of freedom corresponds to pivoting of a curved member 74, whereas the other corresponds to rotation of jaw frame 72.

The tie clamp 32 of FIG. 8 is self-aligning in that, upon activation of cylinder 66 to clamp a tie, rotation of the jaw frame 72 and pivoting of the curved members 74 will automatically adjust the relative positions (i.e., using the degrees of freedom) of the various contact surfaces or pads 74P of a particular jaw so that it conforms to the surface of the tie which is being clamped.

Note that the hourglass shape of plate 72P provides for rotation about an axis at the center of the hourglass shape in between two curved surfaces 72C. The curved members 74 are C-shaped and are captured within sockets of the jaw frame 72 so as to provide for rotation about an axis perpendicular to the axis which extends through the hourglass shape.

Advantageously, the center of rotation of the contact surfaces 74P is near the jaw and tie contact point. This minimizes the moment about the jaw axes created by these forces.

The present tie clamp 32 allows use of long wearing metallic jaws. In other words, the pads or contact surfaces 74P may be made of metal. Previously, jaws for concrete ties have generally been made of rubber or other soft, conforming materials having limited life. It was previously thought advisable to use such limited life materials so as to minimize damage to concrete ties.

Advantageously, the tie clamp 32 of the present invention will conform to concrete ties which have varying cross section.

The operation of the present invention may be summarized as follows:

The truck is located over the rail and the rail engagement wheels are engaged.

The tie exchanger is lowered to the rail by extending the lift cylinders.

The truck is propelled to a tie requiring replacement. The truck is stopped so the boom is directly over the tie.

The rail clamps are engaged.

The crane's outriggers are extended until the rail is lifted adequately.

The boom is retracted and lowered and the tie clamp is closed on the tie.

The boom is extended and the tie is removed. Depending on the length of the tie, the tie may be released, boom retracted, tie clamped and boom extended until the tie is removed.

The truck's crane (or manual labor) remove the tie from the area and place a new tie in reach of the tie exchanger.

The new tie is clamped and inserted by retracting the boom. Multiple strokes may be required.

The tie is released from the tie clamp.

The outriggers are retracted, lowering the rail.

The rail clamps are released.

The truck is propelled to the next tie.

Although various specific constructions have been described herein, it is to be understood that these are for illustrative purposes only. Various modifications and adaptations will be apparent to those of skill in the art. Accordingly, the scope of the present invention should be determined by reference to the claims appended hereto.

We claim:

1. A road vehicle tie exchanger assembly comprising:

an attachment frame for stationary mounting to a frame of a road vehicle;

a support movably mounted to said attachment frame; at least one lift actuator operably connected to lift said support relative to said attachment frame; and a tie exchanger including a tie clamp, said tie exchanger secured at a vertical pivot point to said support, said vertical pivot point corresponding to a vertical axis about which said tie exchanger is pivotable relative to said support, said tie exchanger operable to remove old ties from a rail roadbed and to insert new ties in a rail roadbed; and wherein said tie exchanger is rotatable at least 180 degrees about said vertical pivot point for removal of ties from both right and left sides of the vehicle, and further comprising rail clamps mounted to opposite ends of said support, said rail clamps disposed in a vertical plane in which ties are moved for insertion and removal and wherein said support is a support member disposed directly under said vertical pivot point.

2. The road vehicle tie exchanger assembly of claim 1 wherein said tie exchanger comprises a telescoping boom with said tie clamp mounted on a distal end thereof.

3. The road vehicle tie exchanger assembly of claim 2 mounted to a truck.

4. The road vehicle tie exchanger assembly of claim 3 further comprising a crane and outriggers mounted to said truck.

5. The road vehicle tie exchanger assembly of claim 1 wherein said tie clamp has opposite jaws, each jaw having at least two contact surfaces with one degree of freedom for self-aligning movement upon clamping a tie.

6. The road vehicle tie exchanger assembly of claim 1 wherein said tie clamp has opposite jaws, each jaw having at least two contact surfaces which have at least two degrees of freedom for self-aligning movement upon clamping a tie.

7. The road vehicle tie exchanger assembly of claim 1 wherein sideways forces from insertion and removal of ties are absorbed with no or minimal application of the forces to said attachment frame.

8. The road vehicle tie exchanger assembly of claim 1 further comprising rail engagement means mounted at said opposite ends of said support member.

9. The road vehicle tie exchanger assembly of claim 8 wherein said support member extends lengthwise in a rail-to-rail direction and wherein said rail engagement means are rail engagement wheels.

10. A road vehicle tie exchanger assembly comprising:

an attachment frame for stationary mounting to a frame of a road vehicle;

a support movably mounted to said attachment frame; at least one lift actuator operably connected to lift said support relative to said attachment frame; and a tie exchanger including a tie clamp, said tie exchanger secured at a vertical pivot point to said support, said vertical pivot point corresponding to a vertical axis about which said tie exchanger is pivotable relative to said support, said tie exchanger operable to remove old ties from a rail roadbed and to insert new ties in a rail roadbed; and wherein said tie exchanger is rotatable at least 180 degrees about said vertical pivot point for removal of ties from both right and left sides of the vehicle; and wherein said support has rail clamps mounted to opposite ends of it; and wherein said support is mounted to said attachment frame by parallel link pairs, there being one link pair at each of the opposite ends of said support, said link pairs maintaining the orientation of the support; and wherein said link pairs have spherical ball joint bearings at their ends to allow sideways movement of said support relative to said attachment frame.

11. A road vehicle tie exchanger assembly comprising:

an attachment frame for stationary mounting to a frame of a road vehicle;

a support movably mounted to said attachment frame; at least one lift actuator operably connected to lift said support relative to said attachment frame; and a tie exchanger including a tie clamp, said tie exchanger secured at a vertical pivot point to said support, said vertical pivot point corresponding to a vertical axis about which said tie exchanger is pivotable relative to said support, said tie exchanger operable to remove old ties from a rail roadbed and to insert new ties in a rail roadbed; and wherein said tie exchanger is rotatable at least 180 degrees about said vertical pivot point for removal of ties from both right and left sides of the vehicle; and wherein said support has rail clamps mounted to opposite ends of it; and wherein said support is mounted to said attachment frame by parallel link pairs, there being one link pair at each of the opposite ends of said support, said link pairs maintaining the orientation of the support; and wherein said tie exchanger comprises a telescoping boom with said tie clamp mounted on a distal end thereof; and wherein said telescoping boom is mounted to said support by way of a pivot frame and said telescoping boom is pivotable about a horizontal axis relative to said pivot frame.

12. A tie exchanger assembly comprising:

an attachment frame for stationary mounting to a frame of a vehicle;

a support movably mounted to said attachment frame; at least one lift actuator operably connected to lift said support relative to said attachment frame; and a tie exchanger including a tie clamp, said tie exchanger secured at a vertical pivot point to said support, said vertical pivot point corresponding to a vertical axis about which said tie exchanger is pivotable relative to said support, said tie exchanger operable to remove old ties from a rail roadbed and to insert new ties in a rail roadbed; and wherein said tie exchanger comprises a telescoping boom with said tie clamp mounted on a distal end thereof, and wherein sideways forces from insertion and removal of ties are absorbed with no or minimal application of the forces to said attachment frame; and wherein said telescoping boom includes an inner boom section which extends over said vertical pivot point when said telescoping boom is in a retracted position; and wherein said tie exchanger includes an actuator operable to extend and retract said telescoping boom, and said actuator is mounted adjacent said vertical pivot and said vertical pivot point is centrally located in a rail-to-rail direction.

13. A tie exchanger assembly comprising a tie exchanger operable for removing and inserting ties in a rail roadbed, said tie exchanger having a tie clamp mounted on an end thereof, said tie clamp having opposite jaws, each jaw having at least two contact surfaces which have at least one degree of freedom for self-aligning movement upon clamping a tie, and wherein each jaw has: a jaw frame and a curved member having opposite ends with one of said contact surfaces at each end and an intermediate portion therebetween, said intermediate portion of said curved member pivotably captured within part of the jaw frame; and further comprising two mounts, each jaw frame movable mounted to a corresponding one of said mounts for rotation relative to said corresponding mount to provide self-aligning movement upon clamping a tie.

14. The tie exchanger assembly of claim 13 wherein said contact surfaces have at least two degrees of freedom for self-aligning movement upon clamping a tie.

15. The tie exchanger assembly of claim 13 wherein each of said jaws includes at least three separate contact surfaces.

16. The tie exchanger assembly of claim 13 wherein said tie clamp further includes a tie clamp actuator and opposite tie clamp arms, each tie clamp arm secured to opposite ends of said tie clamp actuator and having one of said jaws movably mounted to it to allow pivoting about a jaw axis.

17. The tie exchanger assembly of claim 13 further comprising an attachment frame for stationary mounting to the frame of a road vehicle, and a support movably mounted to said attachment frame, said tie exchanger mounted to said support.

18. A tie exchanger assembly comprising a tie exchanger operable for removing and inserting ties in a rail roadbed, said tie exchanger having a tie clamp mounted on an end thereof, said tie clamp having opposite jaws, each jaw having at least two contact surfaces which have at least one degree of freedom for self-aligning movement upon clamping a tie; and wherein said tie clamp further includes a tie clamp actuator and opposite tie clamp arms, each tie clamp arm secured to opposite ends of said tie clamp actuator and having one of said jaws movably mounted to it to allow pivoting about a jaw axis; and wherein each jaw has a jaw frame pivotable about the jaw axis of that jaw, each jaw frame having said contact surfaces movably mounted thereto.

19. The tie exchanger assembly of claim 18 wherein each contact surface is pivotable about an associated contact axis relative to said jaw frame.

20. The tie exchanger assembly of claim 19 wherein at least one of said contact surfaces of each jaw is movable independent of another of said contact surfaces of that jaw.

21. The tie exchanger assembly of claim 20 wherein each jaw further comprises a curved member having opposite ends with one of said contact surfaces at each end, each curved member pivotably captured within part of said jaw frame.

22. A tie clamp jaw having a jaw frame and at least two contact surfaces movably mounted to said jaw frame, and wherein said contact surfaces have at least one degree of freedom for self-aligning movement upon clamping a tie; and further comprising a curved member having opposite ends with one of said contact surfaces at each end and an intermediate portion therebetween, said intermediate portion of said curved member pivotable captured within part of said jaw frame, and further comprising a mount to which said jaw frame is movably mounted for rotation of said jaw frame relative to said mount for self-aligning movement upon clamping a tie.

23. The tie clamp jaw of claim 22 wherein said contact surfaces have at least two degrees of freedom for self-aligning movement upon clamping a tie.

24. The tie clamp jaw of claim 22 wherein there are at least three contact surfaces.

25. The tie clamp jaw of claim 22 wherein said jaw frame is pivotably mounted to a retention plate.

26. The tie clamp jaw of claim 22 wherein each contact surface is pivotable about an associated contact axis relative to said jaw frame.

27. The tie clamp jaw of claim 22 combined with a tie exchanger assembly including:

an attachment frame for stationary mounting to a frame of a road vehicle;

a support movably mounted to said attachment frame;

at least one lift actuator operably connected to lift said support relative to said attachment frame; and a tie exchanger including a tie clamp, said tie clamp jaw being part of said tie clamp, said tie exchanger secured at a vertical pivot point to said support, said vertical pivot point corresponding to a vertical axis about which said tie exchanger is pivotable relative to said support, said tie exchanger operable to remove old ties from a rail roadbed and to insert new ties in a rail roadbed; and wherein said tie exchanger is rotatable at least 180 degrees about said vertical pivot point for removal of ties from both right and left sides of the vehicle.

28. The tie clamp jaw of claim 22 further comprising a second curved member having opposite ends with one of said contact surfaces at each end, each curved member pivotably captured within part of said jaw frame.

29. A tie clamp jaw having a jaw frame and at least two contact surfaces movably mounted to said jaw frame, and wherein said contact surfaces have at least one degree of freedom for self-aligning movement upon clamping a tie, further comprising a mount to which said jaw frame is movably mounted for rotation of said jaw frame relative to said mount about a first axis of self-aligning movement upon clamping a tie, and wherein said contact surfaces pivot about a second axis relative to said jaw frame for self-aligning movement upon clamping a tie, said first and second axes respectively defining independent first and second degrees of freedom; and wherein said mount is a retention plate fixed to an anchor plate and said jaw frame includes a captured portion movable captured between said retention plate and said anchor plate, said captured portion having a shape which defines the rotation of the jaw frame.

30. The tie clamp jaw of claim 29 further comprising a curved member having opposite ends with one of said contact surfaces at each end, each curved member pivotably captured within part of said jaw frame.

31. A road vehicle tie exchanger assembly comprising:

an attachment frame for stationary mounting to a frame of a road vehicle;

a support movably mounted to said attachment frame; at least one lift actuator operably connected to lift said support relative to said attachment frame; and a tie exchanger including a tie clamp, said tie exchanger secured at a vertical pivot point to said support, said vertical pivot point corresponding to a vertical axis about which said tie exchanger is pivotable relative to said support, said tie exchanger operable to remove old ties from a rail roadbed and to insert new ties in a rail roadbed; and wherein said tie exchanger is rotatable at least 180 degrees about said vertical pivot point for removal of ties from both right and left sides of the vehicle, and wherein said tie exchanger comprises a telescoping boom with said tie clamp mounted on a distal end thereof and wherein said vertical pivot point is centrally located in a rail-to-rail direction of said support; and wherein said tie exchanger includes an actuator operable to extend and retract said telescoping boom, and said actuator is mounted adjacent said vertical pivot point.

32. The road vehicle tie exchanger assembly of claim 31 wherein said support has rail clamps mounted to opposite ends of it.

33. The road vehicle tie exchanger assembly of claim 32 wherein said support is mounted to said attachment frame by parallel link pairs, there being one link pair at each of the opposite ends of said support, said link pairs maintaining the orientation of the support.

34. The road vehicle tie exchanger assembly of claim 33 further comprising rail engagement wheels mounted at said opposite ends of said support and within 30 centimeters of a vertical plane extending perpendicular to a rail direction and in which said vertical pivot axis is disposed.

35. The road vehicle tie exchanger assembly of claim 33 wherein said tie exchanger comprises a telescoping boom with said tie clamp mounted on a distal end thereof.

36. The road vehicle tie exchanger of claim 31 further comprising rail clamps mounted to opposite ends of said support, said rail clamps disposed in a vertical plane in which ties are moved for insertion and removal.

37. A road vehicle tie exchanger assembly comprising:

an attachment frame for stationary mounting to a frame of a road vehicle;

a support movably mounted to said attachment frame;

at least one lift actuator operably connected to lift said support relative to said attachment frame; and a tie exchanger including a tie clamp, said tie exchanger secured at a vertical pivot point to said support, said vertical pivot point corresponding to a vertical axis about which said tie exchanger is pivotable relative to said support, said tie exchanger operable to remove old ties from a rail roadbed and to insert new ties in a rail roadbed; and wherein said tie exchanger is rotatable at least 180 degrees about said vertical pivot point for removal of ties from both right and left sides of the vehicle, and further comprising rail clamps mounted to opposite ends of said support, said rail calmps disposed in a vertical plane in which ties are moved for insertion and removal; and wherein said rail clamps are mounted approximately in line with said vertical pivot point in a direction perpendicular to a rail direction in order to minimize torque upon insertion and removal of ties by said tie exchanger.

* * * * *

UNITED STATES PATENT AND TRADEMARK OFFICE

CERTIFICATE OF CORRECTION

PATENT NO. : 5,305,692

DATED : April 26, 1994

INVENTOR(S) : Harry MADISON; Robert F. RYAN; Michael B. GILBERT

It is certified that error appears in the above-identified patent and that said Letters Patent is hereby corrected as shown below:

Claim 12, (line 25), column 10, line 63, after "pivot" insert -- point --;

Claim 13, (line 13), column 11, line 10, change "movable" to -- movably --;

Claim 22, (line 9), column 11, line 65, change "pivotable" to -- pivotably --;

Claim 29, (line 15), column 12, line 48, change "movable" to -- movably --;

Claim 29, (line 7),column 12, line 40, change "of" to -- for --;

Claim 37, (line 20), column 14, line 26, change "calmps" to -- clamps --.

Signed and Sealed this

Ninth Day of August, 1994

*Attest:*

Bruce Lehman

BRUCE LEHMAN

*Attesting Officer*

*Commissioner of Patents and Trademarks*